US010010787B1

(12) United States Patent
Tsai

(10) Patent No.: US 10,010,787 B1
(45) Date of Patent: Jul. 3, 2018

(54) THREE-DIMENSIONAL MAZE STRUCTURE

(71) Applicant: Kuo-Ming Tsai, Taichung (TW)

(72) Inventor: Kuo-Ming Tsai, Taichung (TW)

( * ) Notice: Subject to any disclaimer, the term of this patent is extended or adjusted under 35 U.S.C. 154(b) by 0 days.

(21) Appl. No.: 15/661,595

(22) Filed: Jul. 27, 2017

(51) Int. Cl.
*A63F 9/08* (2006.01)
*A63F 9/00* (2006.01)
*A63F 9/06* (2006.01)

(52) U.S. Cl.
CPC ..... *A63F 9/0078* (2013.01); *A63F 9/06* (2013.01); *A63F 2250/485* (2013.01)

(58) Field of Classification Search
CPC ..... A63F 9/0078; A63F 9/06; A63F 2250/485
USPC ..... 273/118 R, 158, 159
See application file for complete search history.

(56) References Cited

U.S. PATENT DOCUMENTS 3,666,269 A * 5/1972 Gilchrist ..... A63B 67/08 273/112
4,726,588 A * 2/1988 Caprio ..... A63F 7/0088 200/404
5,441,260 A * 8/1995 Gogarty ..... A63F 9/0078 273/153 R
6,139,015 A * 10/2000 Hsieh ..... A63F 7/042 273/109
2010/0109240 A1* 5/2010 Ingman, Sr. ..... A63F 9/0078 273/153 R
2013/0225031 A1* 8/2013 Knox, Jr. ..... A45C 1/12 446/10

* cited by examiner

*Primary Examiner* — Vishu Mendiratta

(57) ABSTRACT

A three-dimensional maze structure contains: at least one body and at least one ball. Each body includes a central shaft, multiple partitions, and multiple paths. Each path is defined between any two adjacent partitions, among each path and any two adjacent partitions is formed a trapezoidal oblique surface, and each partitions is distributed by multiple semi-trapezoidal stop pieces, the stop piece has two peripheral ribs horizontally extending outward from two sides of each path to prevent the ball rolling out respectively, and between two facing peripheral ribs of any two adjacent stop pieces is defined a window. Each path has multiple fences and plural passages arranged in an irregular manner. Each ball rolls in each path of each body and a point with the trapezoidal oblique surface, hence each ball rolls and is stopped by the stop piece and then moves through horizontal path of any two adjacent partitions.

7 Claims, 19 Drawing Sheets

THREE-DIMENSIONAL MAZE STRUCTURE

FIELD OF THE INVENTION

The present invention relates to a three-dimensional maze structure in which at least one ball rolls so as to enhance brain function and to obtain entertainment.

BACKGROUND OF THE INVENTION

A conventional maze structure is plane and contains multiple horizontal partitions and vertical partitions which define a path in which a ball rolls. However, it is easy for a user to walk out of the maze structure.

To enhance playing difficulty, a three-dimensional maze structure is formed in a pen shape and contains a plurality of partitions separated from one another. The three-dimensional maze structure also contains plural cutouts defined on the plurality of partitions respectively so as to form a path, hence a ball rolls downwardly in the path via the plural cutouts so as to get out of the three-dimensional maze structure. Nevertheless, it is also easy for a user to walk out of the three-dimensional maze structure.

The present invention has arisen to mitigate and/or obviate the afore-described disadvantages.

SUMMARY OF THE INVENTION

The primary objective of the present invention is to provide a three-dimensional maze structure in which at least one ball rolls to enhance brain function and to obtain entertainment.

To obtain the above mentioned objective, a three-dimensional maze structure provided by a preferred embodiment of the present invention contains: at least one body and at least one ball.

The at least one body continuously extends, each of the at least one body includes a central shaft defined on a central position of a cross section of each body, multiple partitions horizontally extending outward on the cross section of each body from the central shaft, and multiple paths. Each of the multiple paths is defined between any two adjacent partitions, among each path and any two adjacent partitions is formed a trapezoidal oblique surface, and each of the multiple partitions is specifically distributed by multiple semi-trapezoidal stop piece, the stop piece has two peripheral ribs horizontally extending outward from two sides of each path to prevent the ball rolling out respectively, and between two facing peripheral ribs of any two adjacent stop pieces is defined a window. Each path has multiple fences axially extending thereon and arranged in an irregular manner, each path also has a plurality of passages respectively arranged at plural horizontal positions of each path and arranged in an irregular manner.

The at least one ball rolls in each path of each body so as to contact a point with the trapezoidal oblique surface among each path and any two adjacent partitions, hence the at least one ball rolls and is stopped by the stop piece and then moves through horizontal path of any two adjacent partitions, the plurality of passages of each path communicate with one another so that the at least one ball moves from a path of one body to a path of another body.

In another preferred embodiment of the present invention contains: multiple bodies connected together by at least one handle, and each of the at least one handle includes a hollow chamber, wherein each of the multiple bodies includes a free end connecting with the at least one handle and communicating with the hollow chamber of each handle. Each body includes a first central shaft defined on a central position of an interior thereof, multiple first partitions horizontally extending outward from the first central shaft of each body, and multiple first paths. Each of the multiple first paths is defined between any two adjacent first partitions, and each of the multiple first partitions is specifically distributed by multiple semi-trapezoidal stop pieces, the first stop piece has two peripheral ribs horizontally extending outward from two sides of each first path to prevent the ball rolling out respectively, and between two facing peripheral ribs of any two adjacent stop pieces is defined a window. Each first path has multiple first fences axially extending thereon and arranged in an irregular manner, each first path also has a plurality of first passages respectively arranged at plural horizontal positions of each path and arranged in an irregular manner.

A distal end of each body is connected with a lid, and the lid has a through hole configured to put at least one ball into a peripheral tunnel, and after putting the at least one ball, the through hole is closed by a plug, wherein the plug has a first orifice, and the through hole has a second orifice corresponding to the first orifice, hence a bolt inserts into the through hole of the lid from the second orifice via the first orifice.

DETAILED DESCRIPTION OF THE PREFERRED EMBODIMENTS

Figure 1:
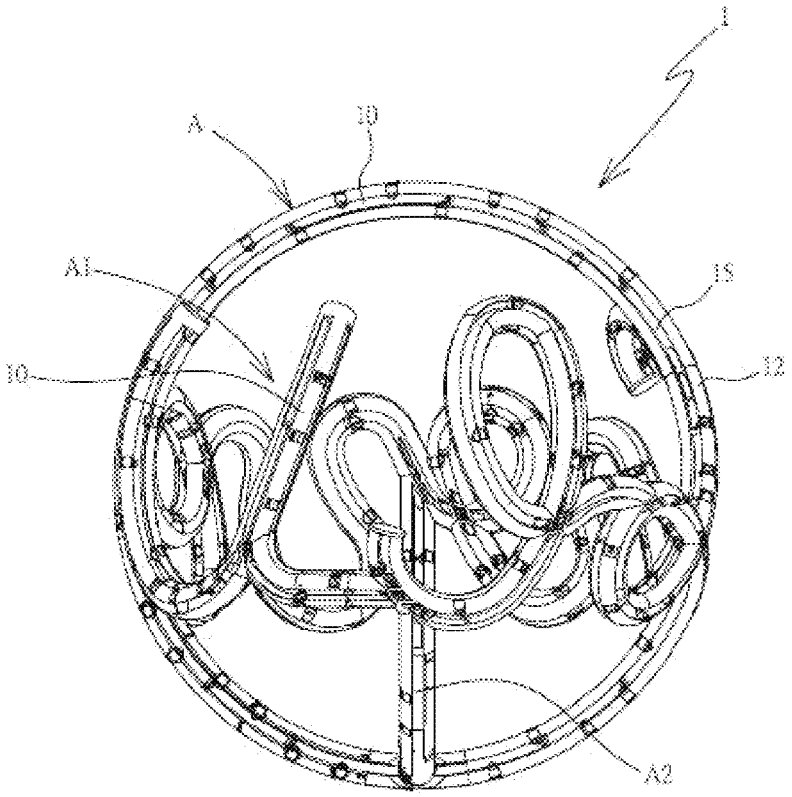
FIG. 1 is a perspective view showing the assembly of a maze structure according to a first embodiment of the present invention.
Figure 2:
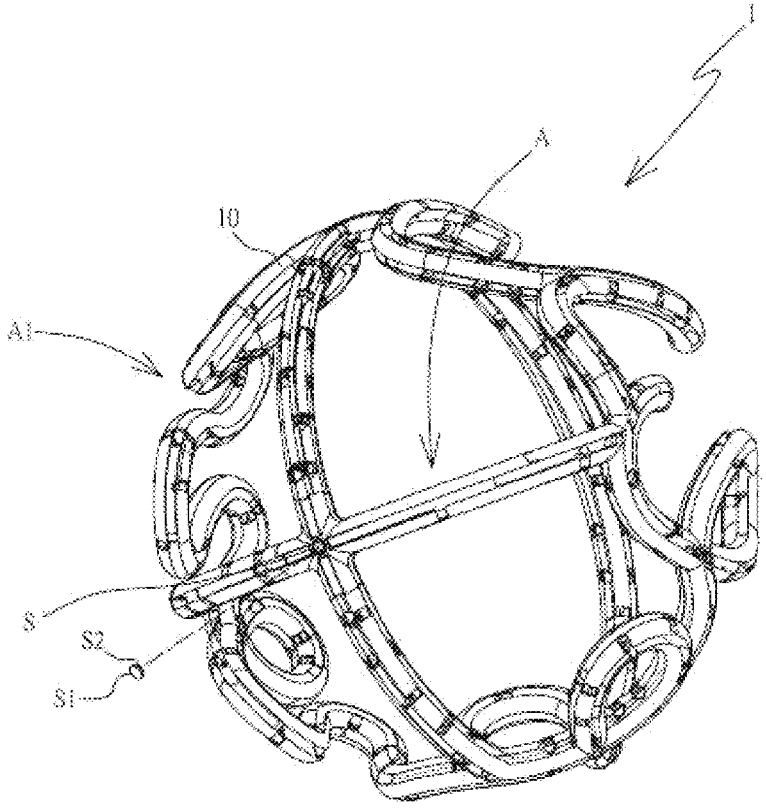
FIG. 2 is a perspective view showing the assembly of a part of the maze structure according to the first embodiment of the present invention.
Figure 3:
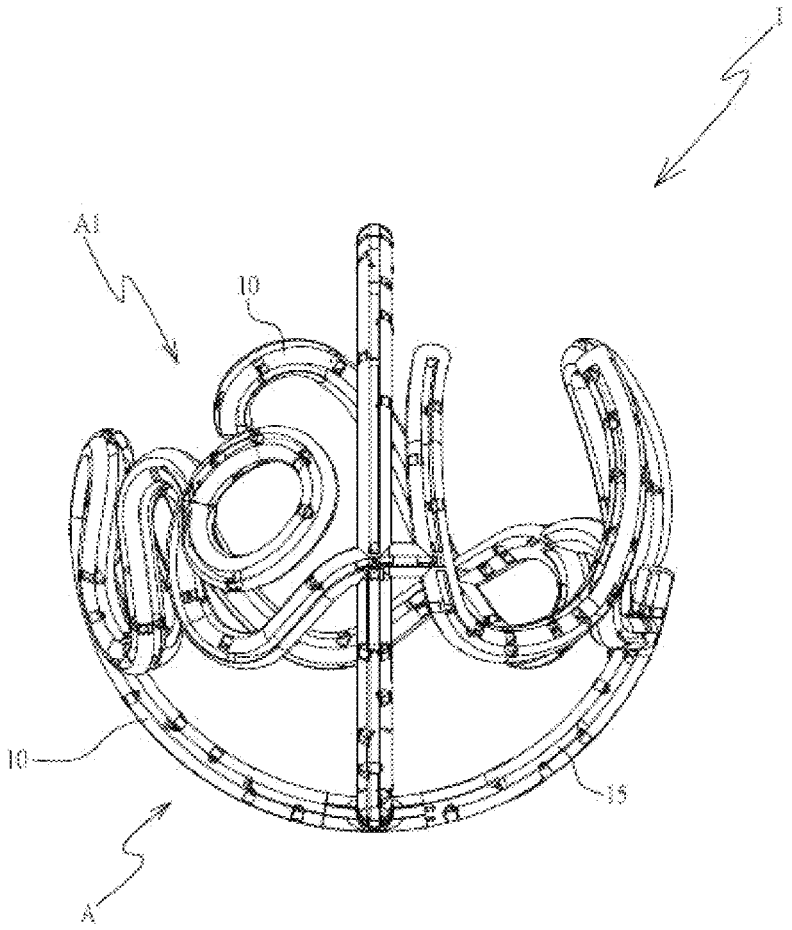
FIG. 3 is another perspective view showing the assembly of the maze structure according to the first embodiment of the present invention.
Figure 4:
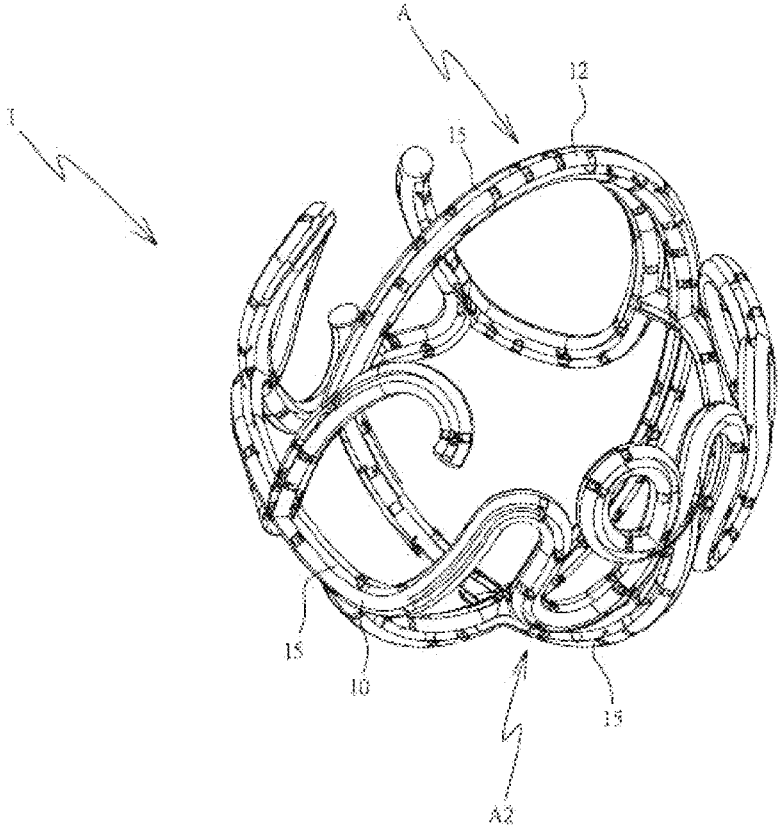
FIG. 4 is also another perspective view showing the assembly of the maze structure according to the first embodiment of the present invention.
Figure 5:
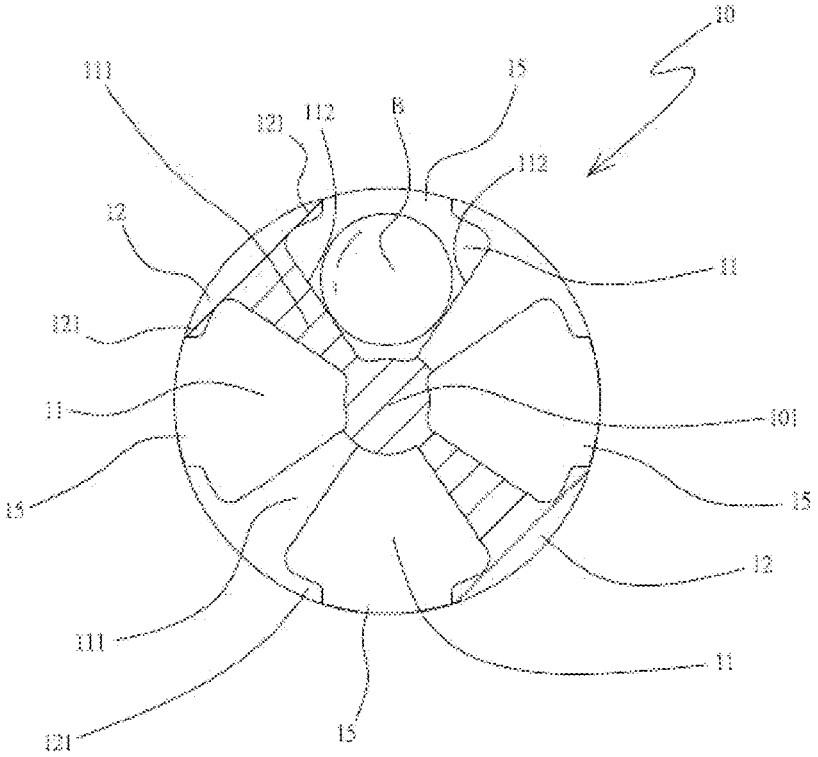
FIG. 5 is a cross sectional view showing the assembly of a body of the maze structure according to the first embodiment of the present invention.
Figure 6:
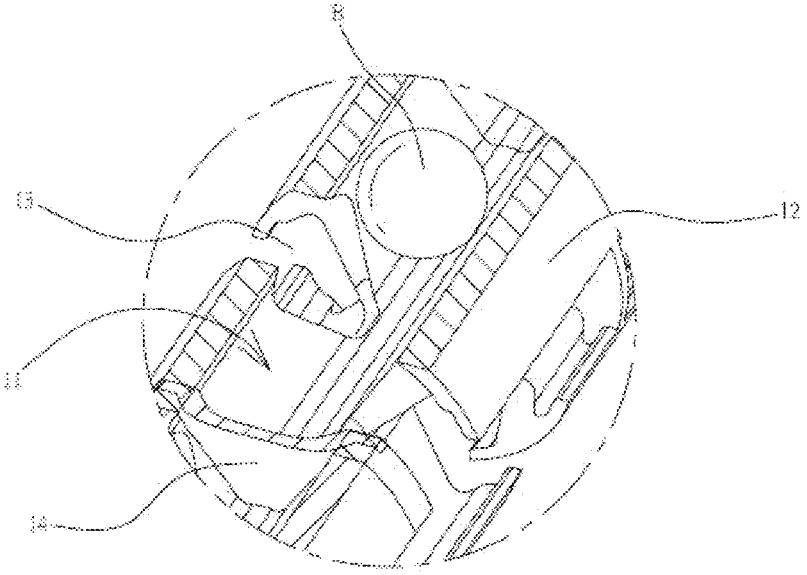
FIG. 6 is a cross-sectional perspective view showing the assembly of a part of the maze structure according to the first embodiment of the present invention.

With reference to FIGS. 1-6, a three-dimensional maze structure 1 according to a first embodiment of the present invention comprises: at least one body 10 and at least one ball B.

The at least one body 10 continuously extends to define a spherical surrounding unit A and a letter forming unit A1, and the letter forming unit A1 is defined on an outer periphery of the spherical surrounding unit A by multiple characters which are continuously arranged in a sphere shape. In this embodiment, the multiple characters of the letter forming unit A1 are "I Love U", and between the letter forming unit A1 and the spherical surrounding unit A is defined a reinforcement unit A2 configured to support the letter forming unit A1 and the spherical surrounding unit A.

Each of the at least one body 10 includes a central shaft 101 defined on a central position of a cross section thereof, four partitions 111 horizontally extending outward on the cross section of each body 10 from the central shaft 101, and four paths 11. Each of the four paths 11 is defined between any two adjacent partitions 111, among each path 11 and any two adjacent partitions 111 is formed a trapezoidal oblique surface 112, and each of the four partitions 111 is covered by a stop piece 12, wherein the stop piece 12 has two peripheral ribs 121 horizontally extending outward from two sides of each path 11 respectively, and between two facing peripheral ribs 121 of any two adjacent stop pieces 12 is defined a window 15 so that a user views each path 11. Each path 11 has multiple fences 14 axially extending thereon and arranged in an irregular manner, each path 11 also has a plurality of passages 13 respectively arranged at plural horizontal positions thereof and arranged in an irregular manner.

The at least one ball B rolls in each path 11 of each body 10 so as to contact with the trapezoidal oblique surface 112 among each path 11 and any two adjacent partitions 111, hence the at least one ball B rolls smoothly and is stopped by the two facing peripheral ribs 121 of any two adjacent stop pieces 12. The plurality of passages 13 of each path 11 communicate with one another so that the at least one ball B moves from a path 11 of one body 10 to a path 11 of another body 10.

Preferably, each body 10 further includes multiple inlet sets S, each of the multiple inlet sets S is configured to put the at least one ball B and is closed by a cap S1, and the cap S1 has a contacting fringe S2 matingly retaining with each inlet set S.

Figure 7:
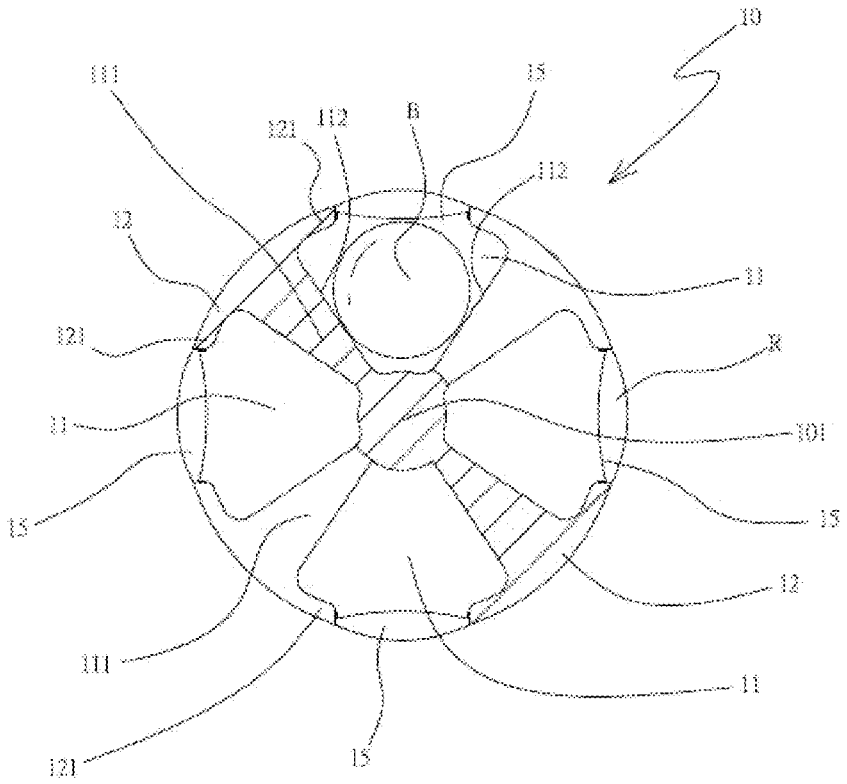
FIG. 7 is a cross sectional view showing the assembly of a part of a maze structure according to a second embodiment of the present invention.
Figure 8:
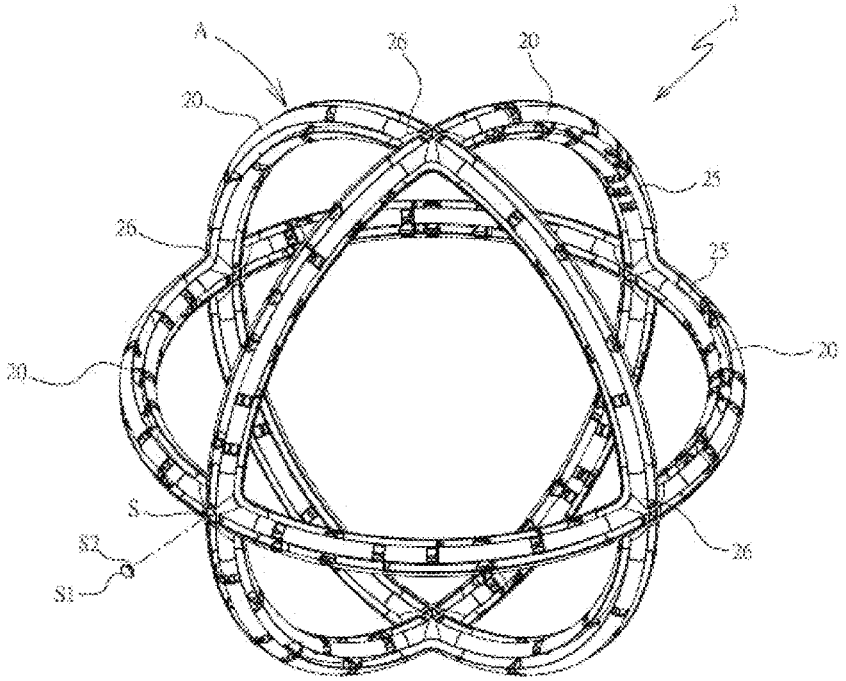
FIG. 8 is a perspective view showing the assembly of a maze structure according to a third embodiment of the present invention.
Figure 9:
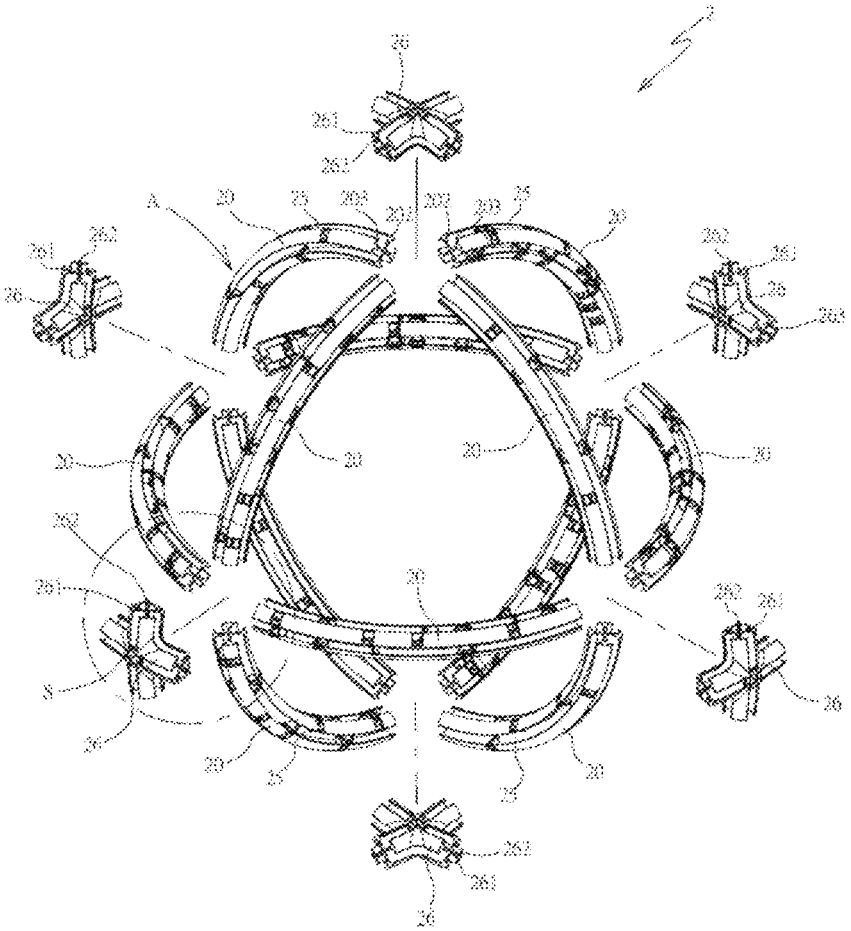
FIG. 9 is a perspective view showing the exploded components of a maze structure according to the third embodiment of the present invention.
Figure 10:
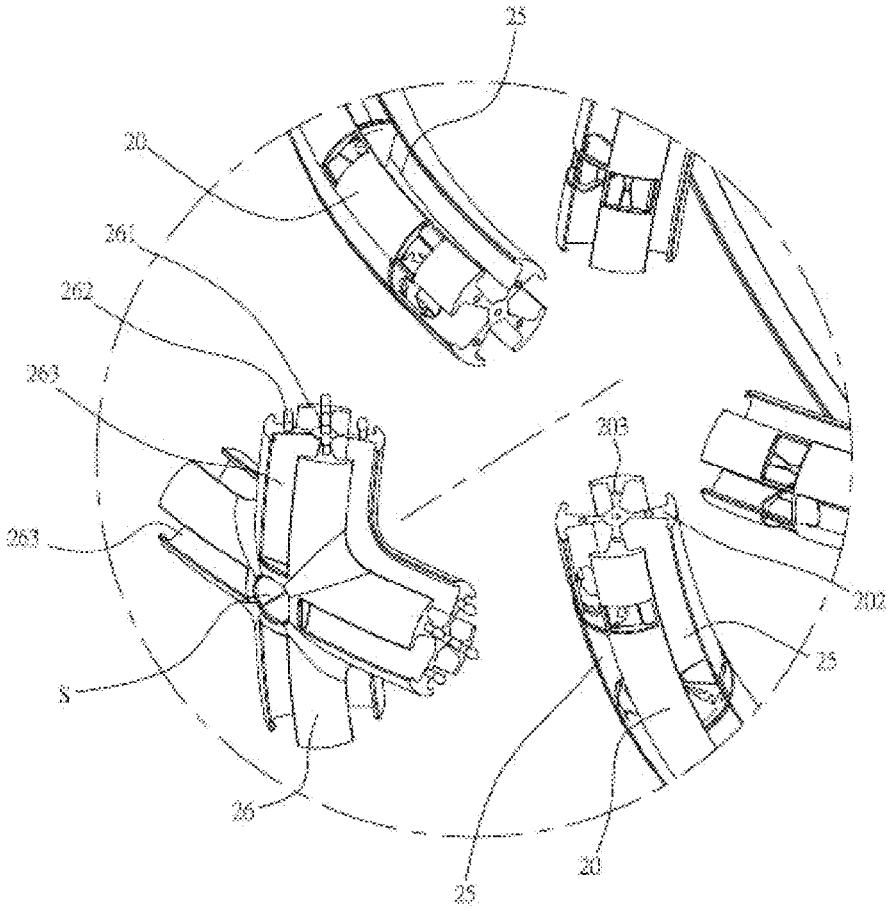
FIG. 10 is an amplified perspective view of FIG. 9.
Figure 11:
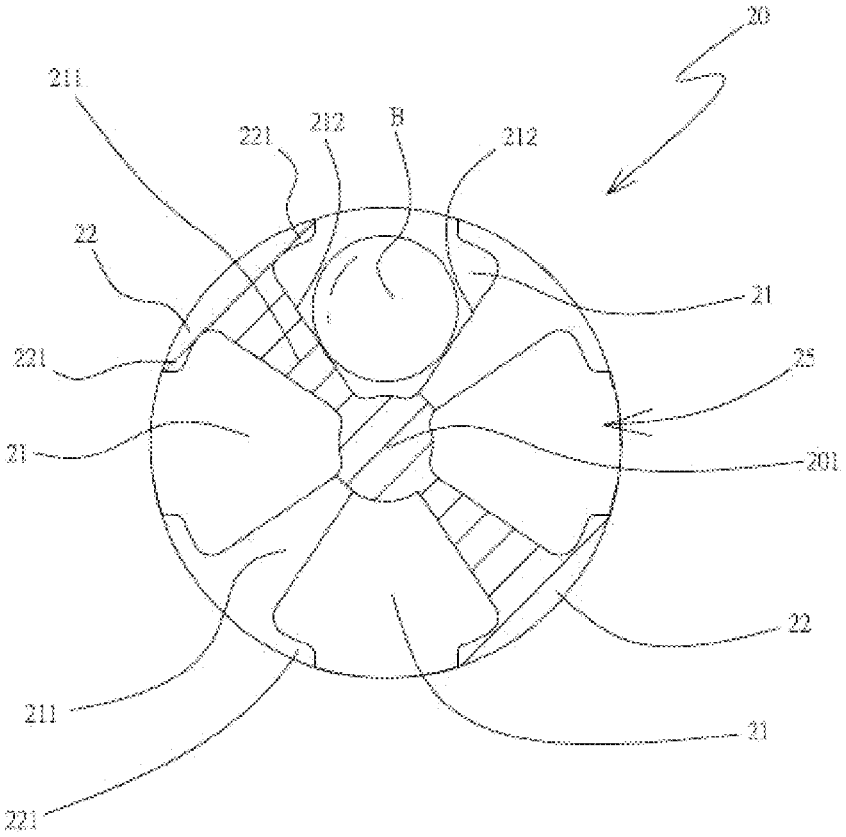
FIG. 11 is a cross sectional view showing the assembly of a part of the maze structure according to the third embodiment of the present invention.
Figure 12:
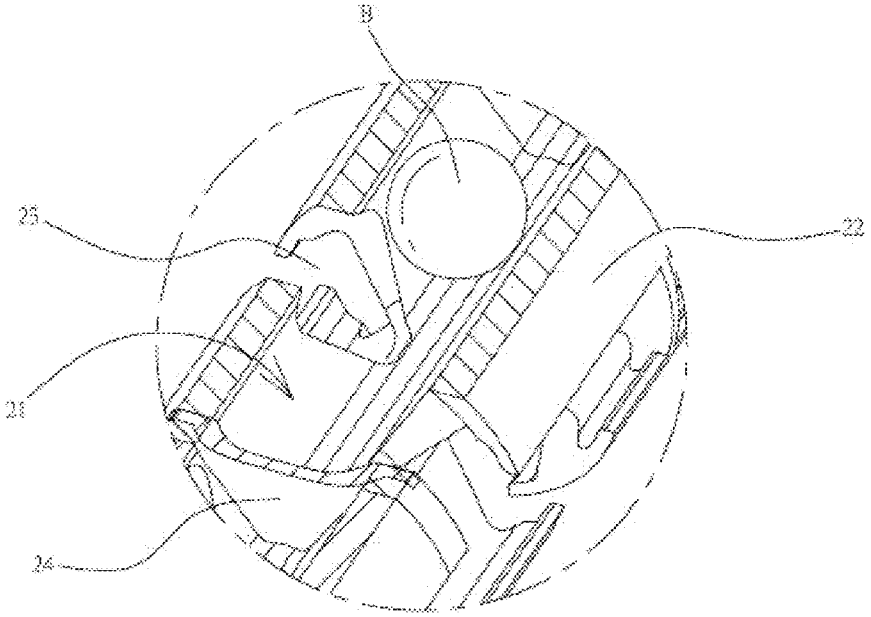
FIG. 12 is a cross-sectional perspective view showing the assembly of a part of the maze structure according to the third embodiment of the present invention.
Figure 13:
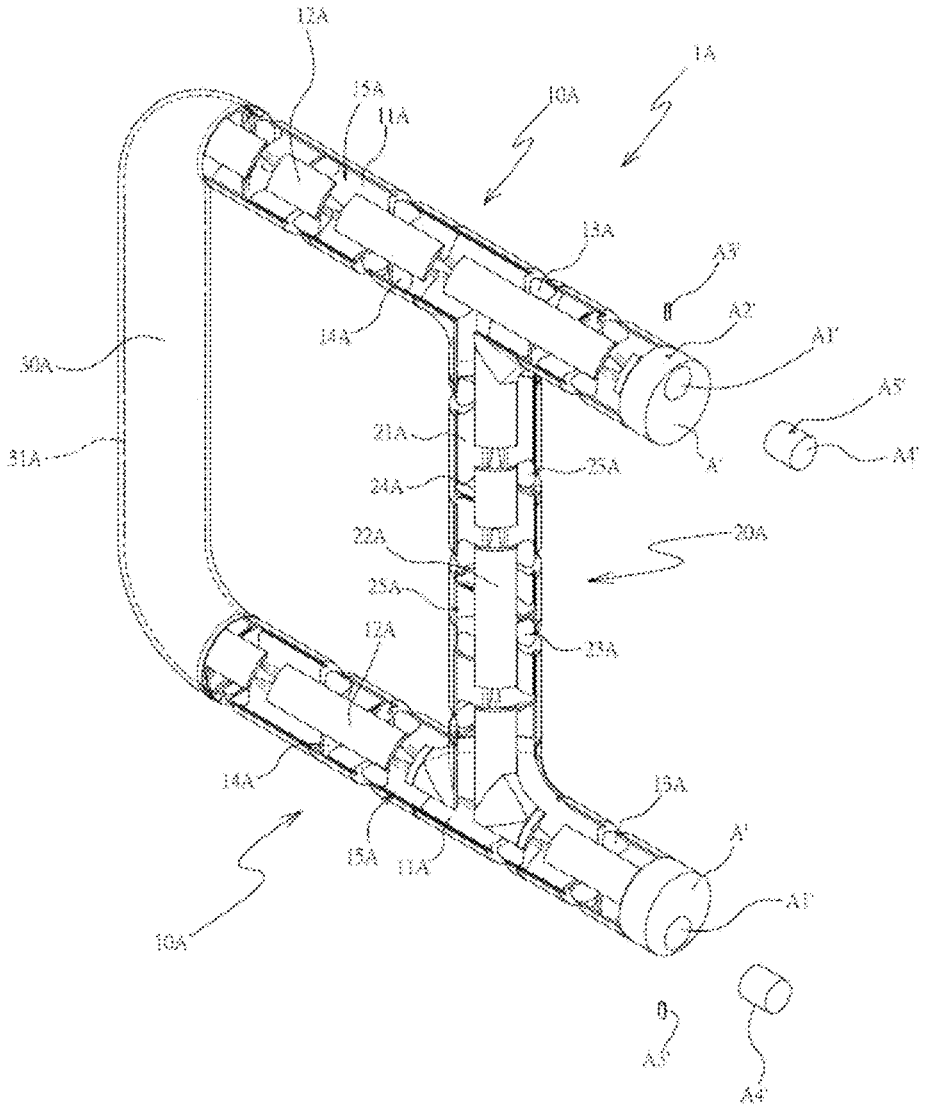
FIG. 13 is a perspective view showing the exploded components of a maze structure according to a fourth embodiment of the present invention.
Figure 14:
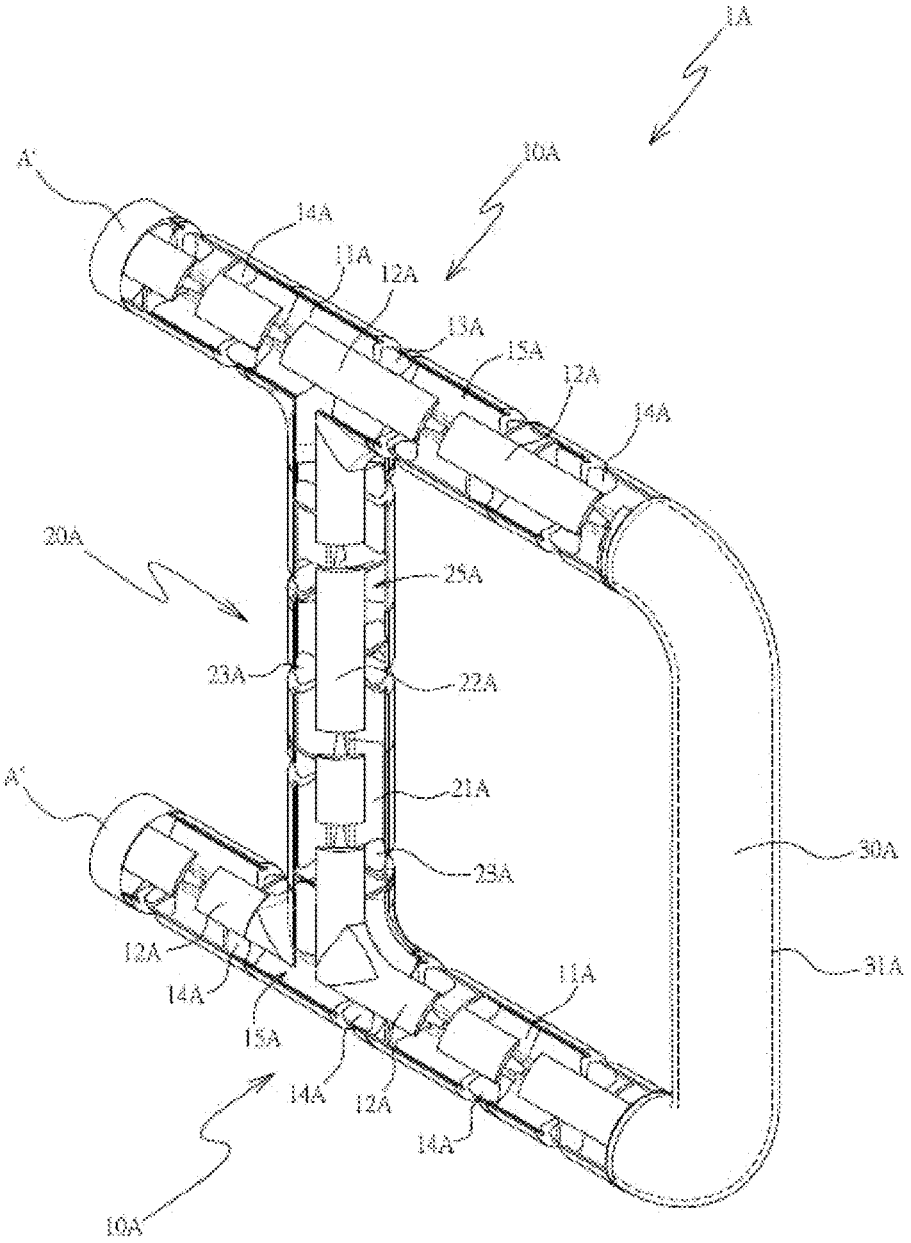
FIG. 14 is a perspective view showing the assembly of the maze structure according to the fourth embodiment of the present invention.
Figure 15:
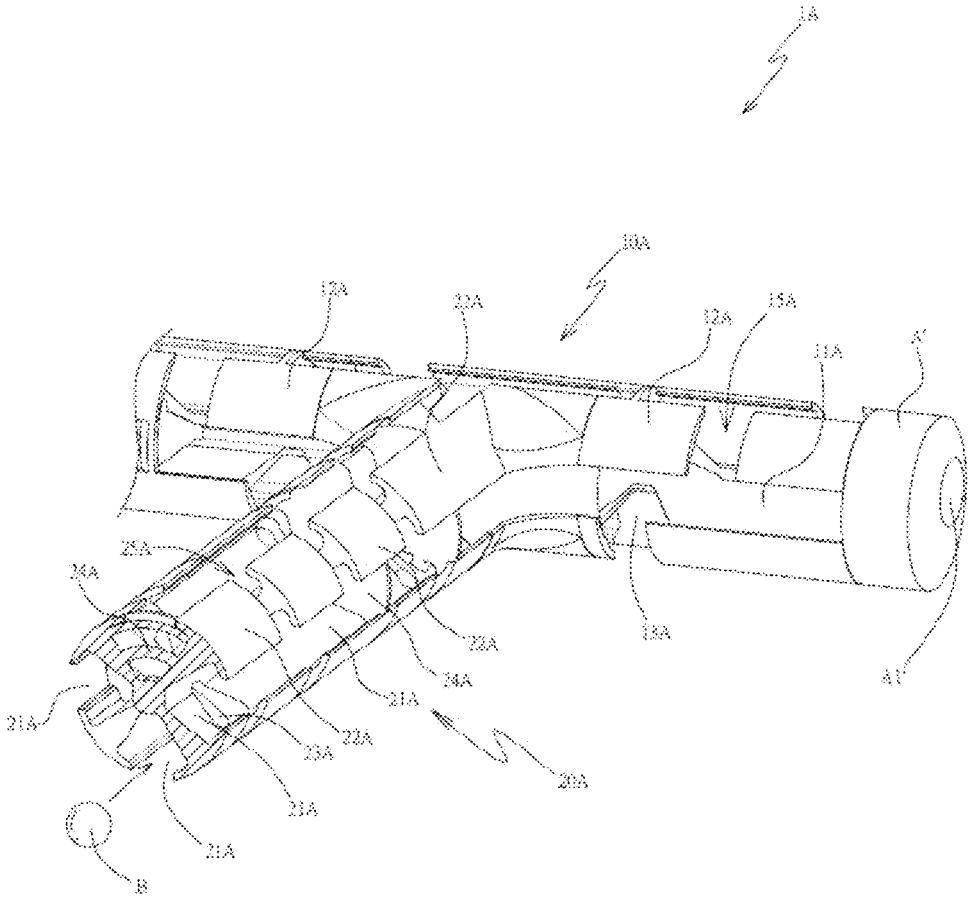
FIG. 15 is a cross-sectional perspective view showing the assembly of a part of the maze structure according to the fourth embodiment of the present invention.
Figure 16:
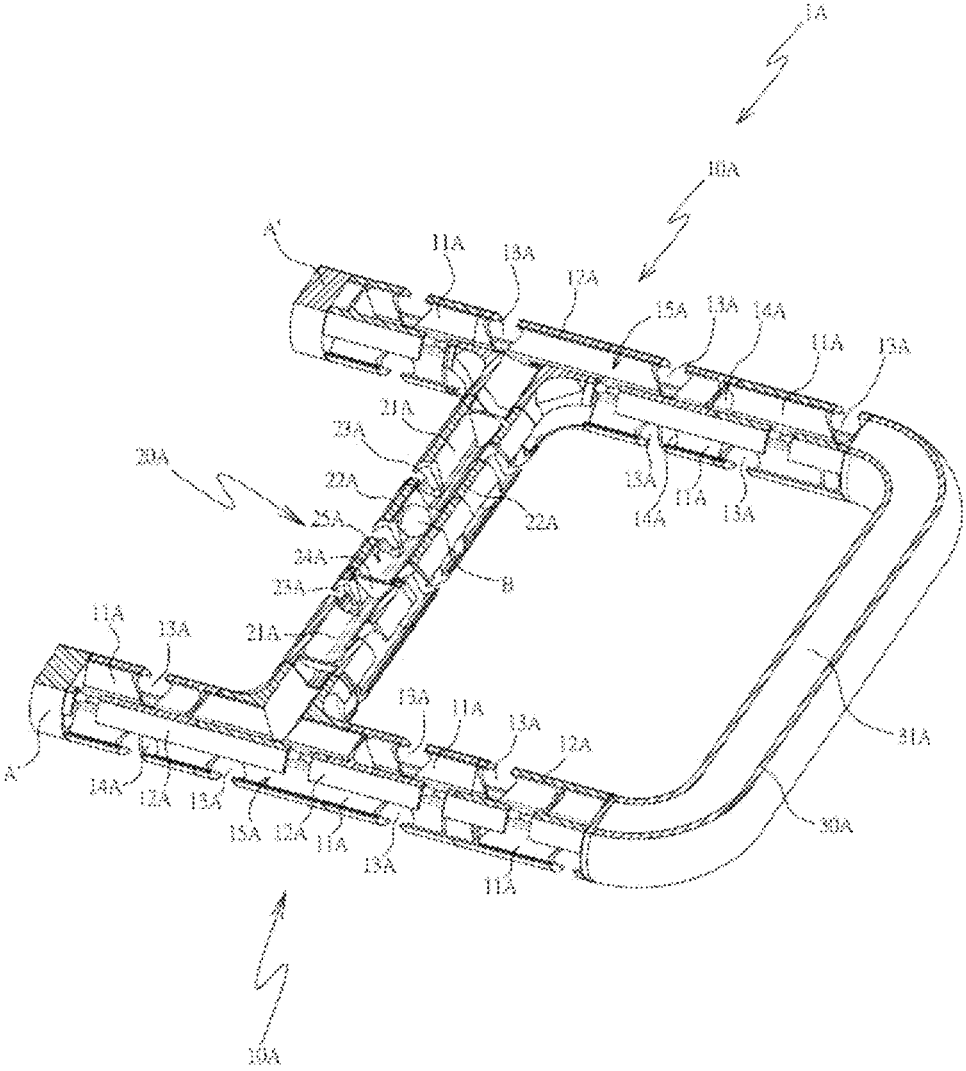
FIG. 16 is a cross-sectional perspective view showing the assembly of the maze structure according to the third embodiment of the present invention.
Figure 17:
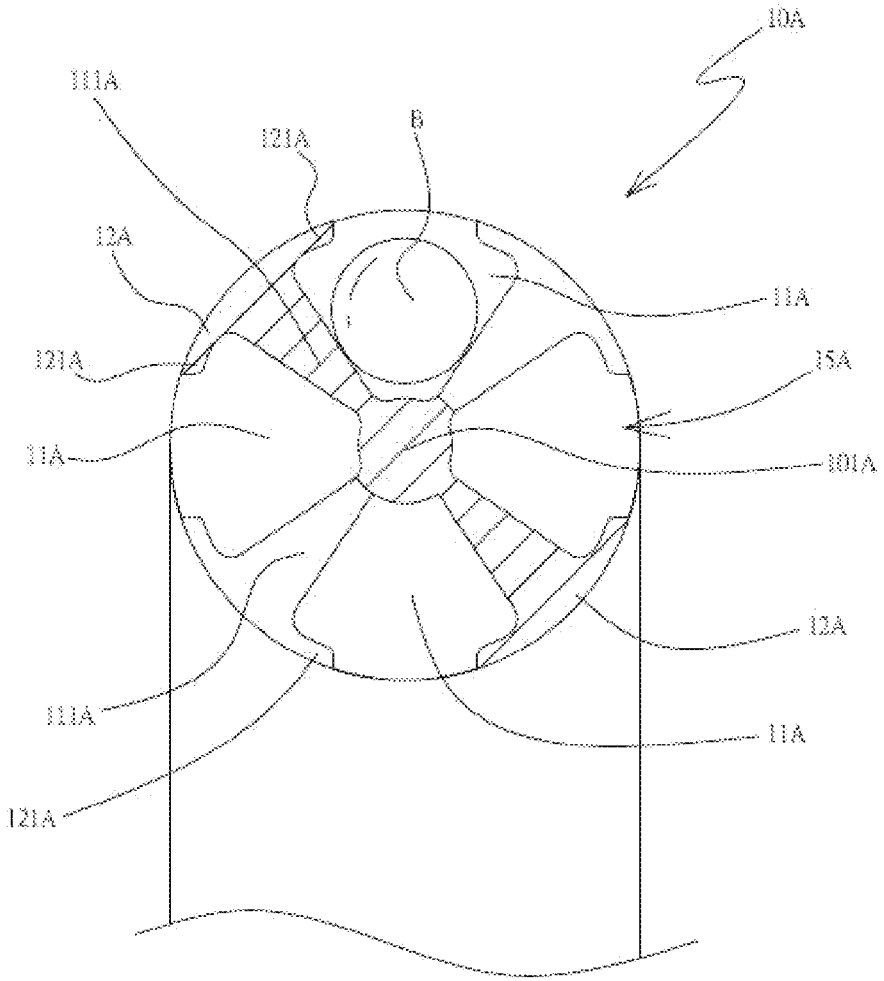
FIG. 17 is a cross sectional view showing the assembly of a part of the maze structure according to the fourth embodiment of the present invention.
Figure 18:
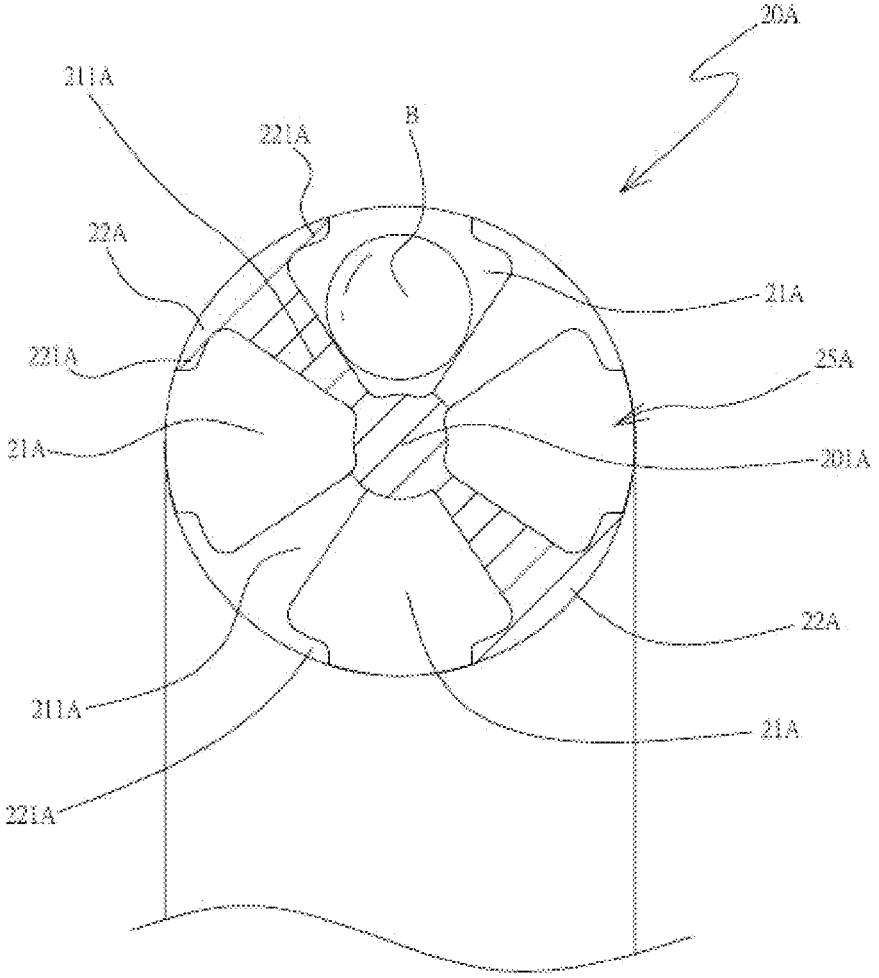
FIG. 18 is another cross sectional view showing the assembly of a part of the maze structure according to the fourth embodiment of the present invention.

Referring to FIG. 7, in a second embodiment, between two facing peripheral ribs 121 of any two adjacent stop pieces 12 is defined a window 15, and the window 15 retains with a transparent cover R which is a convex lens so as to magnify the at least one ball B, thus viewing the at least one ball B clearly.

As shown in FIGS. 8-12, in a third embodiment, the three-dimensional maze structure 1 comprises multiple bodies 20, and each of the multiple bodies 20 include a spherical surrounding unit A and four removable extensions, each of the four removable extensions has a length equal to ¼ perimeter of each body 20. Each body 20 further includes multiple cross-shaped connectors 26, wherein each of the removable four extensions of each body 20 has two first coupling segments 202 formed on two ends thereof respectively, each of the multiple cross-shaped connectors 26 has four second coupling segments 261 formed on four edges thereof respectively, each of the four second coupling segments 261 has a plurality of connection pegs 262, and each of the two first coupling segments 202 has plural notches 203 corresponding to the plurality of connection pegs 262 individually.

Each body 20 has a central shaft 201 defined on a central position of a cross section thereof, four partitions 211 horizontally extending outward on the cross section of each body 20 from the central shaft 201, and four paths 21. Each of the four paths 21 is defined between any two adjacent partitions 211, among each path 21 and any two adjacent partitions 211 is formed a trapezoidal oblique surface 212, and each of the four partitions 211 is covered by a stop piece 22, wherein the stop piece 22 has two peripheral ribs 221 horizontally extending outward from two sides of each path 21 respectively, and between two facing peripheral ribs 221 of any two adjacent stop pieces 22 is defined a window 25 so that a user views each path 21. Each path 21 has multiple fences 24 axially extending thereon and arranged in an irregular manner, each path 21 also has a plurality of passages 23 respectively arranged at plural horizontal positions thereof and arranged in an irregular manner. Furthermore, each cross-shaped connector 26 has a crisscross conduit 263 corresponding to and communicating with the four paths 21 of each body 20.

The at least one ball B rolls in each path 21 of the body 20 so as to contact with the trapezoidal oblique surface 212 among each path 21 and any two adjacent partitions 211, hence the at least one ball B rolls smoothly and is stopped by the two facing peripheral ribs 221 of any two adjacent stop pieces 22. The plurality of passages 23 of each path 21 communicate with one another so that the at least one ball B moves from one of the fourth paths 21 of one body 20 to one of the fourth paths 21 of another body 20.

Preferably, each cross-shaped connector 26 further has inlet set S configured to put the at least one ball B into the four paths 21 and is closed by a cap S1, and the cap S1 has a contacting fringe S2 matingly retaining with each inlet set S.

Referring to FIGS. 13-18, in a fourth embodiment, multiple bodies 10A are connected together by at least one handle 30A, and each of the at least one handle 30A includes a hollow chamber 31A.

Each of the multiple bodies 10A includes a free end connecting with the at least one handle 30A and communicating with the hollow chamber 31A of each handle 30A, and each body 10A is includes a first central shaft 101A defined on a central position of an interior thereof, four first partitions 111A horizontally extending outward from the first central shaft 111A of each body 10A, and four first paths 11A. Each of the four first paths 11A is defined between any two adjacent first partitions 111A, and each of the four first partitions 111A is covered by a first stop piece 12A, wherein the first stop piece 12A has two first peripheral ribs 121A horizontally extending outward from two sides of each first path 11A respectively, and between two facing first peripheral ribs 121A of any two adjacent first stop pieces 12 is defined a first window 15A so that a user views each first path 11A. Each first path 11 has multiple first fences 14A axially extending thereon and arranged in an irregular manner, each first path 11 also has a plurality of first passages 13A respectively arranged in an irregular manner. In addition, a distal end of each body 10A is connected with a lid A', wherein the lid A' has a through hole A1' configured to put at least one ball B into a peripheral tunnel 11'. After putting the at least one ball B, the through hole A1' is closed by a plug A4', wherein the plug A4' has a first orifice A5', and the through hole A1 ' has a second orifice A2' corresponding to the first orifice A5', hence a bolt A3' inserts into the through hole A1 ' of the lid A' from the second orifice A2' via the first orifice A5'.

A support 20A is defined between two bodies 10A, wherein the support 20A has a second central shaft 201A defined on a central position of an interior thereof, four second partitions 211A horizontally extending outward from the second central shaft 201A of the support 20A, and four second paths 21A. Each of the four second paths 1A is defined between any two adjacent second partitions 211A, wherein the fourth second paths 21A communicate with the four first paths 11A, and each of the four second partitions 211A is covered by a second stop piece 22A, wherein the second stop piece 22A has two second peripheral ribs 221A horizontally extending outward from two sides of each second path 21A respectively, and between two facing second peripheral ribs 221A of any two adjacent second stop pieces 22 is defined a second window 25A so that a user views each second path 21A. Each second path 21 has multiple second fences 24A axially extending thereon and arranged in an irregular manner, each second path 21 also has a plurality of second passages 23A horizontally arranged in an irregular manner.

Figure 19:
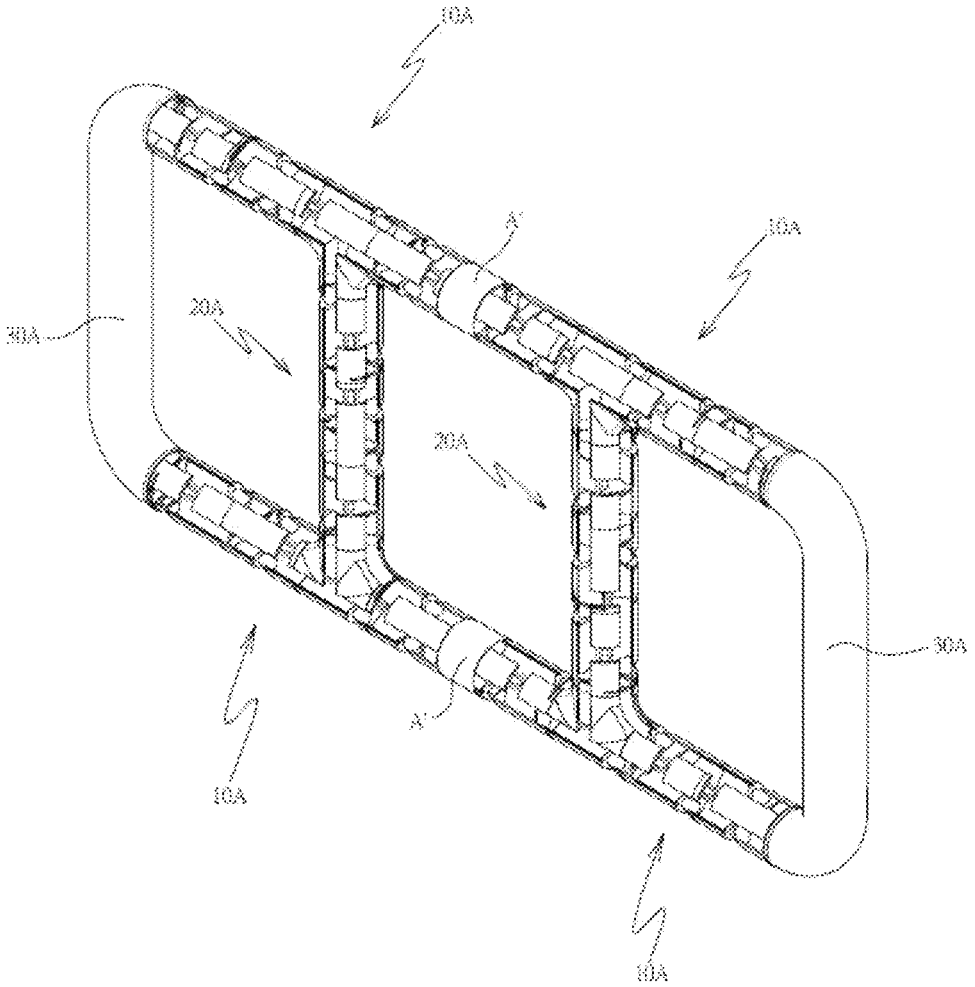
FIG. 19 is a perspective view showing the assembly of a maze structure according to a fifth embodiment of the present invention.

As shown in FIG. 19, in a fifth embodiment, two handles 30A are connected with two bodies 10A so that the user grips and rotates the two handles 30A, hence the at least one ball BA moves, slants, or turns into one of the plurality of first passages, then the at least one ball BA rolls into another of the plurality of first passages. The at least one ball BA also rolls in the hollow chamber 31A of each handle 30A so as to move from one body to another body.

Thereby, the user grips and rotates the spherical surrounding unit A so that the at least one ball B moves, wherein when the at least one ball B slants or turns to enter the plurality of passages, and the at least one ball B are rolled to move into the paths four 11, thus enhancing entertainment. Preferably, the at least one ball B moves from one path 11 to another path 11 of another letter forming unit A1, thus practicing user's hands and brain.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A three-dimensional maze structure comprising:

at least one body continuously extending, each of the at least one body including a central shaft defined on a central position of a cross section of each body, multiple partitions horizontally extending outward on the cross section of each body from the central shaft, and multiple paths, each of the multiple paths being defined between any two adjacent partitions, among each path and any two adjacent partitions being formed a trapezoidal oblique surface, and each of the multiple partitions being specifically distributed by multiple semi-trapezoidal stop pieces, each stop piece having two peripheral ribs horizontally extending outward flanges from two sides of each path to prevent the ball rolling out respectively, and between two facing peripheral ribs of any two adjacent stop pieces is defined a window, each path having multiple fences axially extending thereon and arranged in an irregular manner, each path also having a plurality of passages respectively arranged at plural horizontal positions of each path and arranged in an irregular manner;

at least one ball rolling in each path of each body so as to contact with the trapezoidal oblique surface among each path and any two adjacent partitions, hence the at least one ball rolls and is stopped by the two facing peripheral ribs of any two adjacent stop pieces, the plurality of passages of each path communicate with one another so that the at least one ball moves from a path of one body to a path of another body.

2. The three-dimensional maze structure as claimed in claim 1, wherein each body further includes multiple inlet sets, each of the multiple inlet sets is configured to put the at least one ball and is closed by a cap, and the cap has a contacting fringe matingly retaining with each inlet set.

3. The three-dimensional maze structure as claimed in claim 1, wherein each body includes multiple removable extensions and multiple cross-shaped connectors, each of the removable multiple extensions has two first coupling segments formed on two ends thereof respectively, and each of the multiple cross-shaped connectors has four second coupling segments formed on four edges thereof respectively, wherein each of the multiple second coupling segments has a plurality of connection pegs, and each of the two first coupling segments has plural notches corresponding to the plurality of connection pegs individually.

4. The three-dimensional maze structure as claimed in claim 1, wherein the window retains with a transparent cover which is a convex lens so as to magnify the at least one ball.

5. The three-dimensional maze structure as claimed in claim 1, wherein the at least one body continuously extends to define a spherical surrounding unit and a letter forming unit, and the letter forming unit is defined on an outer periphery of the spherical surrounding unit by multiple characters which are continuously arranged in a sphere shape.

6. A three-dimensional maze structure comprising: multiple bodies connected together by at least one handle, and each of the at least one handle including a hollow chamber, wherein each of the multiple bodies includes a free end connecting with the at least one handle and communicating with the hollow chamber of each handle; each body includes a first central shaft defined on a central position of an interior thereof, multiple first partitions horizontally extending outward from the first central shaft of each body, and multiple first paths; each of the multiple first paths is defined between any two adjacent first partitions, and each of the multiple first partitions is specifically distributed by a first semi-trapezoidal stop piece, wherein the first stop piece has two first peripheral ribs horizontally extending outward from two sides of each first path respectively, and between two facing first peripheral ribs of any two adjacent first stop pieces is defined a first window; each first path has multiple first fences axially extending thereon and arranged in an irregular manner, each first path also has a plurality of first passages respectively arranged in an irregular manner; a distal end of each body is connected with a lid, and the lid has a through hole configured to put at least one ball into a peripheral tunnel, and after putting the at least one ball, the through hole is closed by a plug, wherein the plug has a first orifice, and the through hole has a second orifice corresponding to the first orifice, hence a bolt inserts into the through hole of the lid from the second orifice via the first orifice.

7. The three-dimensional maze structure as claimed in claim 6, wherein at least one support is defined between two of the multiple bodies, each of the at least one support has a second central shaft defined on a central position of an interior thereof, multiple second partitions horizontally extending outward from the second central shaft of the support, and multiple second paths; each of the multiple second paths is defined between any two adjacent second partitions, wherein the multiple second paths communicate with the multiple first paths, and each of the multiple second partitions is covered by a second stop piece, wherein the second stop piece has two second peripheral ribs horizontally extending outward from two sides of each second path respectively, and between two facing second peripheral ribs of any two adjacent second stop pieces is defined a second window; each second path has multiple second fences axially extending thereon and arranged in an irregular manner, and each second path also has a plurality of second passages horizontally arranged in an irregular manner.

* * * * *